US006233132B1

(12) United States Patent
Jenski

(10) Patent No.: US 6,233,132 B1
(45) Date of Patent: May 15, 2001

(54) ZERO CROSS RELAY ACTUATION METHOD AND SYSTEM IMPLEMENTING SAME

(75) Inventor: Leonard Jenski, Roselle, IL (US)

(73) Assignee: Ranco Incorporated of Delaware, Wilmington, DE (US)

( * ) Notice: Subject to any disclaimer, the term of this patent is extended or adjusted under 35 U.S.C. 154(b) by 0 days.

(21) Appl. No.: 09/388,042

(22) Filed: Sep. 1, 1999

Related U.S. Application Data

(60) Provisional application No. 60/099,021, filed on Sep. 3, 1998.

(51) Int. Cl.[7] ..... H01H 9/00

(52) U.S. Cl. ..... 361/160; 361/152; 361/187; 361/2

(58) Field of Search ..... 361/139, 152, 361/154, 160, 170, 187, 195, 202, 206, 209, 2, 7

(56) References Cited

U.S. PATENT DOCUMENTS

| | | | | |
|---|---|---|---|---|
| 4,321,946 | | 3/1982 | Paulos et al. | 137/554 |
| 4,670,810 | * | 6/1987 | Valeur | 361/5 |
| 5,293,551 | | 3/1994 | Perkins et al. | 361/154 |
| 5,644,463 | * | 7/1997 | El-Sharkawi et al. | 361/94 |
| 5,668,476 | | 9/1997 | Archer | 324/546 |
| 5,742,467 | * | 4/1998 | Schmitz | 361/154 |
| 5,774,323 | | 6/1998 | Innes et al. | 361/187 |
| 5,784,245 | | 7/1998 | Moraghan et al. | 361/154 |
| 5,808,471 | | 9/1998 | Rooke et al. | 324/546 |
| 5,841,621 | | 11/1998 | Dean et al. | 361/185 |

* cited by examiner

*Primary Examiner*—Michael J. Sherry
(74) *Attorney, Agent, or Firm*—Terrence Terry Martin; John M. England, Jr.; Jules Jay Morris

(57) ABSTRACT

An electromechanical relay drive system which prolongs relay life by ensuring operation of the relay in a manner to make and break contact between the contact electrodes at a zero crossing point of the switched waveform. Relay aging and environmental variations are dynamically compensated upon each actuation of the electromechanical relay to ensure proper timing of the energization and de-energization of the relay to ensure switching at the zero crossing point. Additionally, the drive system described compensates for variations in the actual contact operation during actuation for the positive and negative half cycle of the switched waveform. Furthermore, the system of the instant invention alternately energizes and de-energizes the electromechanical relay during the positive and negative half cycles of the switched waveform to prevent metal deposition from one contact electrode to the other. This system calculates the appropriate delays on a dynamic historical perspective by sensing slope changes of the coil voltage and current.

29 Claims, 3 Drawing Sheets

ZERO CROSS RELAY ACTUATION METHOD AND SYSTEM IMPLEMENTING SAME

This application claims the benefit of U.S. Provisional Application No. 60/099,021, filed Sep. 3, 1998.

FIELD OF THE INVENTION

The instant invention relates to relay switching circuits, and more particularly to relay timing and control circuits for ensuring zero cross switching of a relay.

BACKGROUND OF THE INVENTION

The switching of electric power has long been a requirement for the operation and control of various systems. These systems include everything from the simple flipping of a light switch to turn on a light or the resetting of a circuit breaker switch which has automatically tripped due to a circuit overload, to the very complex and sophisticated computer controlled switching and load shedding of electric power on the space shuttle. While manually operated electrical switches are adequate for many of these applications, increasingly electronic control is being utilized to effectuate the switching of electric power. Even modern room lighting systems utilize electronic motion sensors to control electrically actuated switches to turn on and off lights within a room.

While small control electronics are well suited for processing the required inputs and performing the required logic to control the switching of the electric power, many of these electronic components operate on digital voltages and currents and are not suitable for the switching of the greater amounts of electric power needed to operate most electrical equipment. While there have been many advances in the development and manufacture of high power switching electronic circuitry, the cost and cooling requirements of these devices, such as IGBTs, MCTs, and MOSFETs, preclude their application in many electric power switching applications. In many of these applications, ranging everywhere from consumer appliances, to electronic wall-mounted hand dryers, to large computer controlled factory equipment, the use of the electronically controlled electromechanical relay provides the required function at a cost and with a reliability which is acceptable.

A typical electromechanical relay, such as that illustrated in FIG. 5, typically comprises at least one, and possibly two drive coils 10. In the case of a single coil relay, the coil 10 is energized to create a magnetic field which pulls a moveable contact electrode 12 into physical contact with a stationary contact electrode 14 to complete the electrical circuit between the two power terminals 16, 18 for a normally open relay. If the relay is of the normally closed type, the energization of the drive coil 10 will create a magnetic field which separates the physical contact of the two contact electrodes 12, 22 thereby breaking the electrical circuit between the two power terminals 18, 20. These single coil relays also typically include a bias spring (not shown) to hold the moveable contact electrode into its quiescent state, i.e. away from the stationary contact electrode 14 for a normally open relay, and in contact with the stationary electrode 22 in the normally closed type relay. Various other designs are available for relays depending upon the particular application requirements. More sophisticated electromechanical relay designs include both a drive open and a drive close coil, requiring the application of an electrical drive signal to both open and close the relay. Other designs include latching type relays which allow the coil current to be switched off once the relay has transitioned, as well as coil cutthroat mechanisms which ensure that both the open and close drive coils are not energized at the same time. Other relay designs provide both normally opened and normally closed contacts, and many provide auxiliary contacts for relay position sensing for feedback control.

Regardless of the particular construction of the actual relay switching element, its reliability will be determined by the number of cycles it will withstand in its lifetime. As one skilled in the art will recognize, the mechanical simplicity and robustness of a typical relay design does not provide the limiting factor which determines the relays life. Instead, the typical limiting factor in a relay's life is a purely electrical phenomenon occurring in most relays upon the opening and closing of the contact electrodes. Specifically, the opening and closing of the contact electrodes results in an electrical arc forming across the contacts for a small period of time. The period of time during which an arc flows is determined by many factors including the mechanical bounce of the contacts upon closure, the distance between the contact electrodes, the magnitude of current flowing, as well as the level of ionization of the air in the gap between the contact electrodes. This electrical arc will also be extinguished, in the case where an AC current is being switched, when the voltage between the contacts traverses through zero and the cycle changes from positive to negative or negative to positive.

The electrical arc between the contact electrodes of an electromechanical relay limit the life of the relay in essentially two ways. First, the electrical arcing leaves carbon deposits on each of the contact electrodes which, over time, build up to form a high resistance contact between the contact electrodes. This high contact resistance results in increased heat dissipation within the electromechanical relay, as well as reduced voltage available at the relay output. Eventually, the material build up on the contact electrode surfaces will result in intermittent contact of the contact electrodes. This intermittent contact results in the electrical circuit not being completed when the relay is energized due to the insulating properties of the build up material which prevent a physical contact of the conductive material of the contact electrodes.

A second way in which the life of an electromechanical relay is shortened by the electrical arc formed between the contacts during opening and closure thereof is a result of the extreme heat of an electrical arc. Specifically, as an electrical arc is drawn between the two contact electrodes, a small portion of the contact electrode material will be melted or vaporized off of the surface. The amount of material burned away during each cycle during which an arc is formed is a function of the voltage and current which the relay is attempting to switch. The higher the current flow between the electrical contact electrodes, the hotter the electrical arc, and thus the more contact material that is burned away. A second factor is the amount of contact material on the surface of the contact electrode. While gold provides a very high fidelity electrical contact, its expense requires that it be plated onto the surface of the contact electrode in relatively thin layers. These gold plated contacts are particularly susceptible to failure from electrical arcs drawn during the switching operation due in part to the small amount of gold which is present and in part because of the softness of gold itself.

An alternate failure mode of electromechanical relays due to the arc generated, primarily during closure of the contacts, is the welding together of the contact electrodes.

Specifically, as the contact electrodes come into contact, the force with which they are brought together typically results in a slight mechanical bounce of the two contact electrodes, resulting in multiple contact and separation events in a very short period of time. Each of these bounce events results in the generation of an electrical arc which tends to greatly increase the temperature of the contact electrode surfaces. This particular failure mode is generated when the surface material on the contact electrodes is heated to a sufficient degree to liquify, to some degree, the surface material. If both electrical contact surface materials are liquefied and the contact electrodes are brought into physical contact, these two electrodes will be welded together. Such an event is a latent failure, the existence of which is not known until it is desired to break the electrical contact to de-energize the load to which the relay is connected. At that point it is realized that the relay has been welded in a closed configuration, and the circuit is no longer able to be broken, resulting in the continued energization of the electrical load.

As this problem has existed since the invention of the very first switch, many attempts have been made to overcome this problem. A family of solutions exist whereby an electronic controller attempts to control the physical opening and closing of the electromechanical relay at a point of minimum voltage difference between the electrodes. Specifically, it is desirable to open or close the contact electrodes when the voltage existing on the relay is zero volts (at the zero crossing of AC waveform). However, since actuation of an electromechanical relay requires the physical movement of the contact electrodes, there will be some delay from the initial close command issued by the electronic controller until the magnetic field has built to a sufficient level to begin movement of the contact electrodes by overcoming the spring force. Additionally, there will also be a delay due to the amount of time it takes for the contacts to transition from their fully open to fully closed position.

Prior attempts to measure the contact closure and opening timing have involved the measurement of the voltage across the contacts or the load. However, this method has certain problems including that resulting from the contact bounce on closure. It is a phenomenon of electromechanical relays that as the relay contacts become aged, they tend to have more electrical bounce. This bounce in turn provides false data for contact timing measurement. Other methods to measure contact closure and opening timing include the determination of the nominal contact timing at the time of manufacture of the electromechanical relay, and using this data in the electronic controller as a built-in delay. This method however presents problems as the relay ages and the timing of the opening and closure changes, since there is no means of compensating for the fixed delays stored in the controller. An additional effect on the nominal timing of the opening and closure exists with variations in drive voltage and operating temperature of the environment in which the relay is situated.

Another problem exists with prior controllers in that they do not distinguish between switching during the positive or negative cycle of the AC waveform, nor at the beginning or the end of the AC waveform half cycle. In the first situation, where controllers do not distinguish between switching during the positive or negation half cycle of the AC waveform, plating of metal from one contact electrode to the other may result. While this process may be slowed by the controller which attempts to open and close the contacts near the zero cross point of an AC waveform, the process will still eventually result in failure of the contacts.

The second consideration which prior designs have failed to recognize, that of closing at the beginning or the end of a half cycle of the AC waveform, also reduces the life of the relay over an optimized design. Specifically, since variations in the timing of the relay opening and closing cannot be measured before they occur, the electronic actuation with a built-in delay will likely result in a closure of the contacts (or an opening of the contacts) at a point slightly displaced from the actual zero crossing instant of the AC waveform. If the contact is transitioned such that the opening or closing with bounce occurs at the beginning of a half cycle of the AC waveform to be switched, a small arc may be formed which will increase in intensity as the voltage difference between the electrodes increases at the start of the half cycle, and may last for the entire length of that half cycle (8.333 milliseconds for a 60 hertz AC waveform). On the other hand, if the contacts are transitioned to make or break the physical contact slightly before the zero cross point, the arc which may be generated, in addition to being small to begin with, will be extinguished as the voltage difference between the electrodes continues to fall as the zero cross point is approached.

There therefore exists a need in the art for an electronic controller which overcomes these and other known problems existing in the art which decrease the reliability and lifetime of electromechanical relays.

SUMMARY OF THE INVENTION

In view of the above problems existing in the art, and failure of prior attempts to overcome these problems, it is a primary object of the instant invention to overcome these and other known problems existing in the art. Specifically, it is an objective of the instant invention to provide a electromechanical relay drive control circuit which minimizes the arcing between contact electrodes during cycling of the electromechanical relay. More particularly, it is an object of the instant invention to provide a control circuit which dynamically determines the actual contact electrode opening and closing timing to ensure that the delay used in the control circuitry is accurate under the changing circumstances of electromechanical relay operation. It is a further object of the instant invention to provide this electromechanical relay control which is cost efficient and highly reliable. In this way, it is an object of the instant invention to increase the lifetime service of electromechanical relays without prohibitively increasing the cost of its associated control or reducing the overall system reliability of the control/electromechanical relay system.

In view of these objects, it is a feature of the instant invention that the physical opening and closing timing of the contact electrodes are measured during each on and off cycle of the electromechanical relay. It is a further feature of the instant invention that this dynamic timing measurement to be accomplished by monitoring the electrical feedback from the relay coil during contact closure. It is a further feature of the instant invention that the contact electrode opening is measured by the voltage produced by the collapsing magnetic field around the coil. Specifically, it is a feature of the instant invention that this timing is identified by a pattern of the changing slope that corresponds to the field of the coil decaying followed by a rise/fall in the slope that represents the contacts/armature opening. It is an additional feature of the instant invention that the relay turn on and turn off is alternated between positive and negative half cycles of the switched waveform to prevent the plating of metal from one contact to another. Further, it is a feature of the instant invention that the control institutes different timing when opening the contacts on the positive half cycle of the switched waveform than when opening the contacts on the negative half cycle to ensure proper operation over the entire operating lifetime of the electromechanical relay, it is an additional feature of the instant invention that the AC cycle be measured from rising edge to rising edge, and falling edge to falling edge to compensate for any hardware circuitry variations in the detecting of the AC cycle timing.

In view of the above objects and features, a preferred embodiment of the instant invention utilizes an AC voltage waveform sensing circuit to detect the zero voltage cross thereof. Further, a slope detector is coupled to both the positive and negative side of the relay coil with a current sense resistor in series and in parallel with the relay coil itself. In a preferred embodiment, control logic is included to calculate the relay opening and closing time to dynamically set the control delay for the relay coil drive. Preferably, the control logic monitors a history of the relay actuation time upon each actuation to allow dynamic prediction of the relay coil actuation over the relay's lifetime.

In a preferred embodiment of the instant invention, a method of controlling the actuation of an electrical relay having a coil and at least two electrical contacts, one of which being coupled to an electrical source, comprises the steps of actuating the relay, monitoring a first electrical parameter of the coil during actuation of the relay, calculating an actuation time of the relay based on the monitored first electrical parameter of the coil, monitoring a second and a third electrical parameter of the electrical source, calculating an actuation command delay based on the actuation time of the relay and the second parameter of the electrical source, and delaying actuation of the relay for the actuation command delay based on the third electrical parameter. Preferably, the step of monitoring the first electrical parameter of the coil comprises the step of detecting the slope of the first electrical parameter. This method preferably further comprises the step of determining actual actuation of the contacts based on a transition to a positive slope of the first electrical parameter following a negative slope of the first electrical parameter.

In a further preferred embodiment the step of actuating the relay comprises the step of actuating the relay to make electrical contact between the two electrical contacts. In this embodiment, the step of monitoring the first electrical parameter of the coil comprises the steps of monitoring current flow to the coil and detecting a slope of the monitored current flow. Additionally, the step of monitoring the first electrical parameter further comprises the step of determining actual closing of the contacts based on a transition to a positive slope of the current flow following a negative slope of the current flow.

In an alternate preferred embodiment, the step of actuating the relay comprises the step of actuating the relay to break electrical contact between the two electrical contacts. In this embodiment, the step of monitoring the first electrical parameter of the coil comprises the steps of monitoring voltage across the coil and detecting a slope of the monitored voltage. Preferably, the step of monitoring the first electrical parameter further comprises the step of determining actual opening of the contacts based on a transition to a positive slope of the voltage following a negative slope of the voltage.

In a preferred embodiment of the method of the instant invention, the step of monitoring a second and a third electrical parameter of the electrical source comprises the steps of monitoring the frequency of the electrical source and monitoring a zero cross of the electrical source respectively. Further, the step of delaying is preferably begun upon detection of a zero cross. Additionally, in a preferred method the step of calculating an actuation command delay comprises the steps of calculating a first actuation command delay for actuation of the relay during a positive half cycle of the electrical source, and calculating a second actuation command delay for actuation of the relay during a negative half cycle of the electrical source. Further, the step of delaying actuation preferably comprises the step of alternating between the first actuation command delay and the second actuation command delay. In a highly preferred embodiment, the steps of monitoring a first electrical parameter of the coil and calculating an actuation time of the relay are performed upon each actuation of the relay.

An alternate embodiment of the instant invention contemplates a method of calculating relay contact actuation time, the relay having at least one coil and at least one set of contacts. This method comprises the steps of monitoring a coil energization command, monitoring a slope of an electrical parameter of the coil during energization thereof, determining a point of contact actuation based on a change of the slope of the electrical parameter of the coil, and timing a period from the coil energization command to the point of contact actuation. Preferably, the step of monitoring a slope of an electrical parameter comprises the step of monitoring the slope of current flow through the coil. Alternately, the step of monitoring a slope of an electrical parameter comprises the step of monitoring the slope of voltage across the coil. In this embodiment, the step of monitoring the slope of voltage across the coil is performed during opening of the relay.

In a preferred embodiment of the instant invention, wherein a source of ac electric power is coupled to one of the at least one set of contacts, the method further comprises the step of monitoring a second electrical parameter of the source of electric power. Further, the step of timing comprises the steps of timing a period from the coil energization command to the point of contact actuation upon relay energization during a positive half cycle of the source of ac electric power, and timing a period from the coil energization command to the point of contact actuation upon relay energization during a negative half cycle of the source of ac electric power.

In a preferred embodiment the step of timing comprises the steps of timing a first period from the coil energization command to the point of contact actuation upon relay energization to close the at least one set of contacts, and timing a second period from the coil energization command to the point of contact actuation upon relay energization to open the at least one set of contacts. Further, the step of monitoring a slope of an electrical parameter of the coil during energization thereof preferably comprises the steps of monitoring a slope of current flowing through the at least one coil during relay closing, and monitoring a slope of voltage across the at least one coil during relay opening. In an alternate preferred embodiment, the step of determining a point of contact actuation based on a change of the slope of the electrical parameter of the coil comprises the step of determining the point of contact actuation upon the detection of a positive slope after the occurrence of a negative slope after an initial positive slope upon energization.

A relay actuation circuit for use with a relay having at least one coil and at least one set of contacts, at least one of the contacts being coupled to a source of ac electric power in accordance with the teachings of the instant invention comprises a slope detector circuit coupled to the coil and monitoring a slope of a parameter of electric power during energization of the coil, a relay driver circuit, and a logic processor circuit in sensory communication with the slope detector circuit, and in controllable contact with the relay driver circuit. Preferably, the logic processor circuit includes a timing circuit and determines a relay actuation delay time as a period from initiation of the relay driver circuit to a positive change in slope of the parameter following a negative slope after an initial positive slope.

In a preferred embodiment, the circuit further comprises a source voltage zero cross sense circuit having an input in sensory communication with the source of ac electric power and an output coupled to the logic processor. In this embodiment, the logic processor monitors the zero cross information and calculates a frequency of the source voltage. Further, the logic processor circuit calculates a relay actuation command delay time based on the relay actuation delay time and the frequency of the source voltage to minimize a voltage difference between each of the contacts of the relay upon actuation. The logic processor circuit initiates operation of the relay driver circuit upon expiration of the relay actuation command delay time. The relay actuation command delay time is preferably started after detection of a zero cross of the source voltage.

In an alternate preferred embodiment, the logic processor circuit calculates a first relay actuation delay time for actuation of the relay during a positive half cycle of the source voltage and a second relay actuation delay time for actuation of the relay during a negative half cycle of the source voltage. Further, the logic processor circuit alternates actuation of the relay between the positive and the negative half cycles of the source voltage. Alternatively, the logic processor circuit calculates a first relay actuation delay time for opening of the relay contacts, and a second relay actuation delay time for closing of the relay contacts. As a further alternate, the logic processor circuit calculates a first relay actuation delay time for opening of the relay contacts during a positive half cycle, a second relay actuation delay time for opening of the relay contacts during a negative half cycle, a third relay actuation delay time for closing of the relay contacts during a positive half cycle, and a fourth relay actuation delay time for closing of the relay contacts during a negative half cycle.

In a preferred embodiment of the circuit of the instant invention, the slope detector circuit comprises a current sensor circuit coupled in series with the coil for monitoring current through the coil during energization of the coil. Alternatively, the slope detector circuit comprises a voltage monitor circuit coupled in parallel with the coil for monitoring voltage across the coil during energization of the coil. Still further, the slope detector circuit preferably comprises a current sensor circuit coupled in series with the coil for monitoring current through the coil during energization of the coil to close the contacts, and a voltage monitor circuit coupled in parallel with the coil for monitoring voltage across the coil during energization of the coil to open the contacts.

These and other objectives, features, and aspects of the invention will become more apparent from the following detailed description when taken in conjunction with the accompanying drawings.

Figure 1:
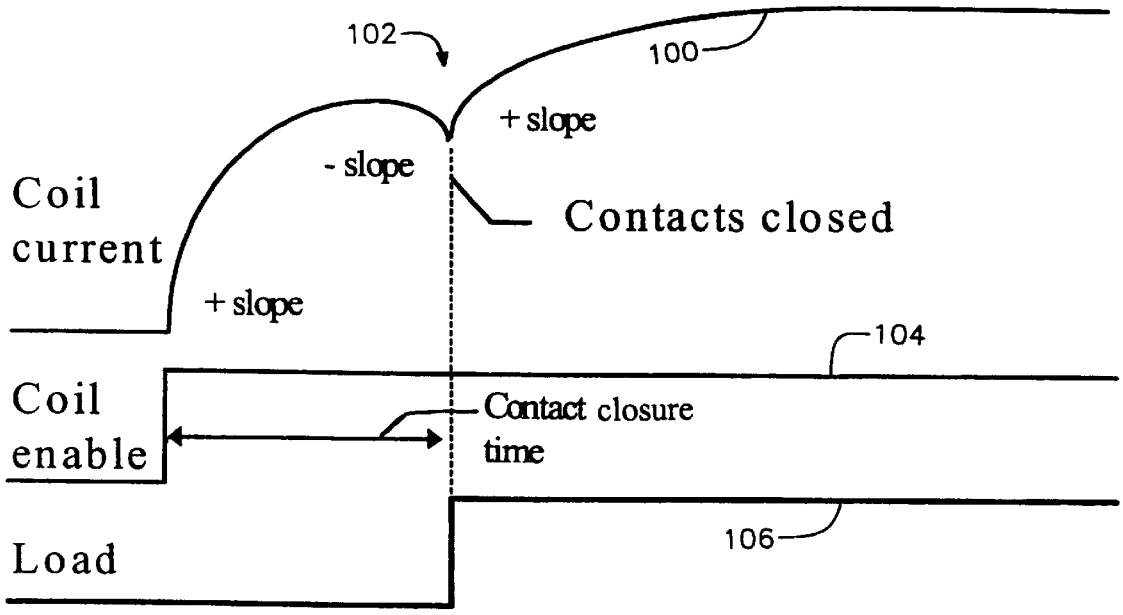
FIG. 1 is a graphical illustration of an electromechanical coil current characteristic during coil energization during contact closure.

While the invention is susceptible of various modifications and alternative constructions, certain illustrative embodiments thereto have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENT

As described above, in order to operate an electromechanical relay controller in a manner to allow the opening and closing of the contact electrodes at the zero crossing of the AC waveform to be switched, the actual timing of this opening and closing event needs to be known. Also as described above, the prior methods of measuring these opening and closing events have been affected by relay aging, electrical bounce, drive voltage, and temperature. Therefore, an embodiment of the instant invention measures the contact opening and closing times dynamically to ensure that the delay utilized by the electronic controller is compensated for the various parameters which affect this time. While it is impossible to anticipate the actual relay actuation time, these dynamic readings of prior actuations are used to approximate the anticipation of the actuation time for each subsequent operation of the relay. This history information of the actual relay actuation time is thus updated each time the relay is physically operated.

The contact electrode closing and opening may be measured electrically by monitoring the electrical feedback from the relay coil. As illustrated in FIG. 1, the electromechanical relay coil current 100 exhibits a brief and small magnitude of current change 102 during the closing of the relay contact electrodes. This change is thought to occur due to a change in inductance of the electromagnet as the relay contact electrodes close. This coil current 100 may be sensed in any known manner, and is preferably sensed by placing a current sense resistor in series with the electromagnetic relay coil and monitoring the voltage resulting thereacross.

As may be seen from FIG. 1, the electromagnet relay coil current 100 initially increases with a positive slope, which then becomes negative as the contact electrodes are closed. Thereafter, the coil current 100 once again exhibits a positive slope until its steady state current level is reached. The change in slope from positive to negative and back to positive is the event 102 which may be utilized to determine the actual contact closure period for the electromagnet relay. Specifically, the contact closure time is timed from the initial coil enable signal 104 being initiated to the coil current event 102. Once the contact electrodes have come into physical contact, the voltage seen at the load 106 goes high.

Figure 2:
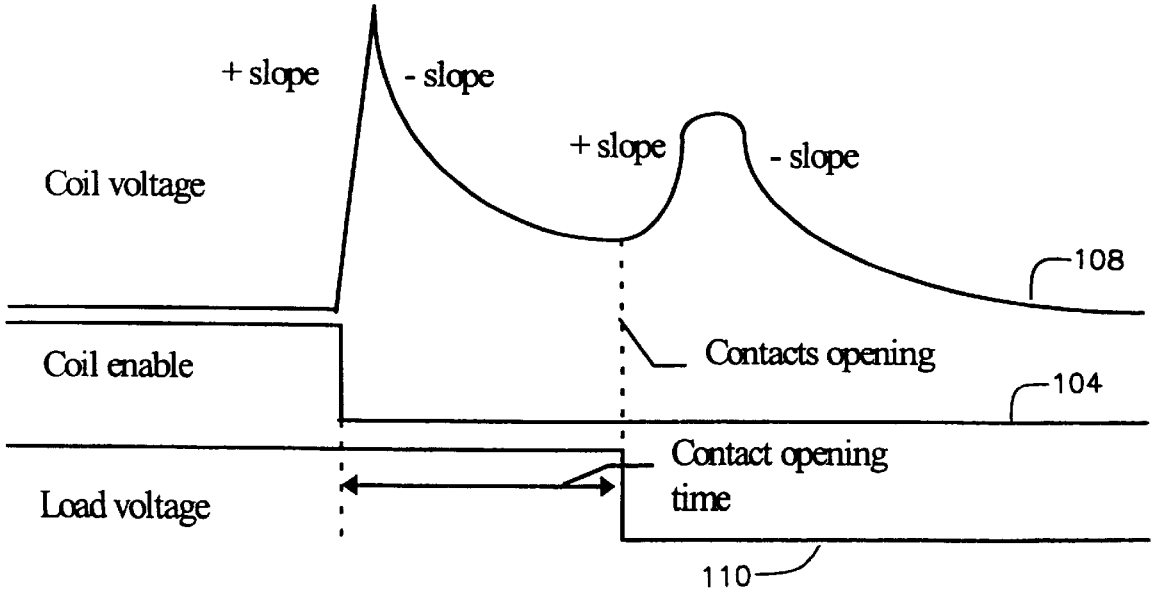
FIG. 2 is a graphical representation of a relay coil voltage characteristic during contact opening.

The opening of the electromagnet relay contact electrodes provides a different scenario than the phenomenon of the coil current illustrated in FIG. 1 during contact closure. Specifically, during opening of the contact electrodes, the voltage produced by the collapsing magnetic field around the drive coil may be monitored, as opposed to the coil current, to determine the contact opening point. In typical coil drive circuits, a diode or diode/zener snubber network is coupled across the coil to prevent the back EMF which is generated when the coil is switched off from destroying the drive transistor. However, if the common snubber network is removed and a high voltage transistor with a resistor is placed across the coil, then the voltage across the coil has a unique voltage pattern that represents the opening of the contacts as illustrated in FIG. 2 by voltage trace 108. As may be seen, this unique pattern is identified by a changing slope that corresponds to the field of the coil decaying followed by a rise/fall in the slope that represents the contacts opening. When this pattern of the coil voltage 108 is compared to the voltage delivered to the load 110 it may be seen that the change in slope from negative to positive of the coil voltage 108 indicates the contact opening point. The actual contact opening time is calculated from the coil enable signal 104 going low until the slope of the coil voltage 108 changes from negative to positive as illustrated in FIG. 2.

Figure 3:
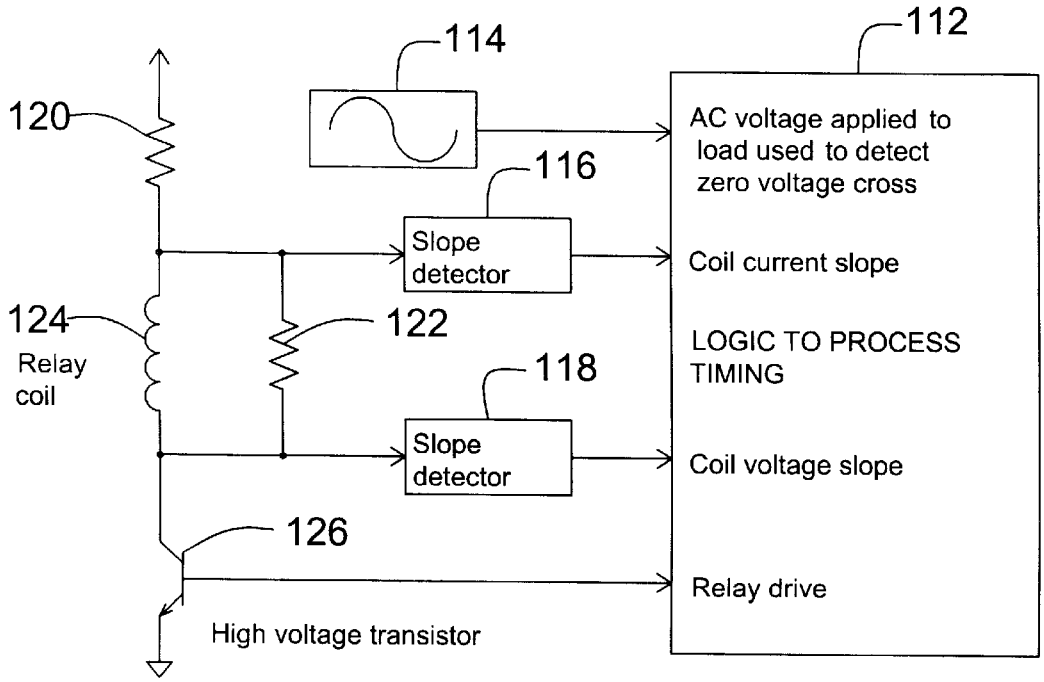
FIG. 3 is a simplified block diagram of an embodiment of the instant invention.

With an understanding of these two phenomena having been established, direction is now turned to FIG. 3 which illustrates an embodiment of the instant invention in block diagrammatic form. As may be seen from this FIG. 3, the electromagnet relay drive and control circuit comprises a logic circuit 112 which may be a general purpose microprocessor, programmable logic array (PLA), custom application specific integrated circuit (ASIC), or other appropriate circuitry known in the art for processing logic and timing signals. Included in this logic circuit 112 are the appropriate input/output conditioning circuits required for the particular implementation chosen. The logic circuitry 112 utilizes an AC voltage sense 114 to detect the zero crossing point of the AC voltage waveform applied to the load. This system also includes both a coil current slope detector 116 and a coil voltage slope detector 118 to allow proper sensing of the above-described coil phenomena. While various types of detectors may be utilized to detect the coil current and voltage, an embodiment of the instant invention utilizes a series load resistor 120 and a parallel load resistor 122, although other more costly sensing devices may be utilized, and are considered to be within the scope of the instant invention. The system of the instant invention energizes the relay coil 124 by driving a high voltage transistor 126. This high voltage transistor may be of any appropriate technology, including a MOSFETt, IGBT, MCT, etc.

The logic circuit 112 utilizes the slope detectors 116, 118 and the relay drive signal 128 to determine the relay actuation time for both the opening and the closing of the contact electrodes upon each actuation. This timing is then utilized by the logic circuit 112 to calculate a delay time to be used in generating the relay drive signal 128. Specifically, this timing is used to determine the exact point in time relative to the AC waveform when the relay drive signal 128 should be initiated to ensure relay contact actuation at the zero crossing point of the AC waveform. The logic circuitry 112 also determines on which half cycle of the AC waveform the relay drive signal 128 is initiated. The logic 112 then alternates which half cycle of the AC waveform during which the relay drive signal 128 will be initiated. As described above, the alternating of the relay turn on and off between positive and negative half cycles prevents the plating of metal from one contact electrode to the other.

During the development of this feature of the instant invention, it was discovered that the timing for the opening of the contacts varies depending on the polarity of the current flowing through the contact electrodes. That is to say, the timing is different when opening the contact electrodes on the positive half cycle then it is when opening the contact electrodes on the negative half cycle of the AC waveform. It is believed that this difference in timing is a result of the AC current either assisting or impeding the opening of the contacts upon actuation. Therefore, a preferred embodiment of the instant invention measures the timing for both situations, i.e. opening during the positive half cycle and opening during the negative half cycle, and uses different delay times depending on whether the opening is to occur on the positive or negative half cycle. As a result, the preferred embodiment of the instant invention stores four time delay values, a positive turn on delay, a negative turn on delay, a positive turn off delay, and a negative turn off delay. Since the relay will be turned on during both a negative and positive half cycle of the AC waveform, this waveform is preferably measured for rising edge to rising edge, and falling edge to falling edge timing to compensate for any variations due to hardware circuitry variations of the AC cycle timing detected thereby.

During operation of the instant invention, the AC power that is used to drive the load attached to the relay is sampled for a cycle time (zero cross to zero cross). Having determined the cycle time of the AC waveform to be switched by the relay, the zero crossing point is again detected. Once the zero cross point has been detected, a delay is initiated followed by, at the expiration of the delay, the generation of the relay drive signal 128. Once the relay drive signal has been initiated, the slope detector 116 which monitors the coil current is sampled to determine the contact closure time from the phenomenon 102 illustrated in FIG. 1. The time period from the enable or energization of the relay coil by generation of the relay drive signal 128 to the detection of the current slope transition 102 (see FIG. 1) is measured to determine the time it takes for the relay contact electrodes to close. This period is then subtracted from the AC cycle period, resulting in a time delay to be used for the delay period for the next turn on of the relay.

The procedure for the turn off delay measurement is the same as that described above, with the exception that the slope detector 118 is utilized. This slope detector 118, however, will detect two slope changes. The first slope change is the back EMF slope resulting from the opening of transistor 126, while the second slope change results from the relay contacts opening. It is this second slope change that is utilized to measure the delay required to compensate for the contact opening time. The delay measurements for the opening and closing time during the opposite half cycles are measured and calculated in the same way, and stored separately within the logic circuit 112.

The measurement of these delay times occurs each time the electromagnet relay is actuated. This provides a current measurement of the actual delay of the relay in its changing environment and at its current age. These measured delays are used for each successive cycling of the relay to ensure that the delay timing approximates as close as possible the anticipated relay opening and closure time. In this manner a constant history is being logged so that long term changes in the relay caused by both age and environment will be compensated over time. This will allow the relay contacts to consistently close and open at the zero voltage crossing point of the AC voltage waveform. However, since no system is able to perfectly anticipate the actual closing time or opening time of any particular cycle, optimal performance is achieved by minimizing the variation in control parameters such as, for example, utilizing a regulated voltage supply for the relay coil. As will be recognized by one skilled in the art, the load reference in the above discussions is assumed to be a resistive load. If, however, an inductive load is to be controlled via the system of the instant invention, the zero cross detection must be a current measurement of the load, not a voltage measurement.

Figure 4:
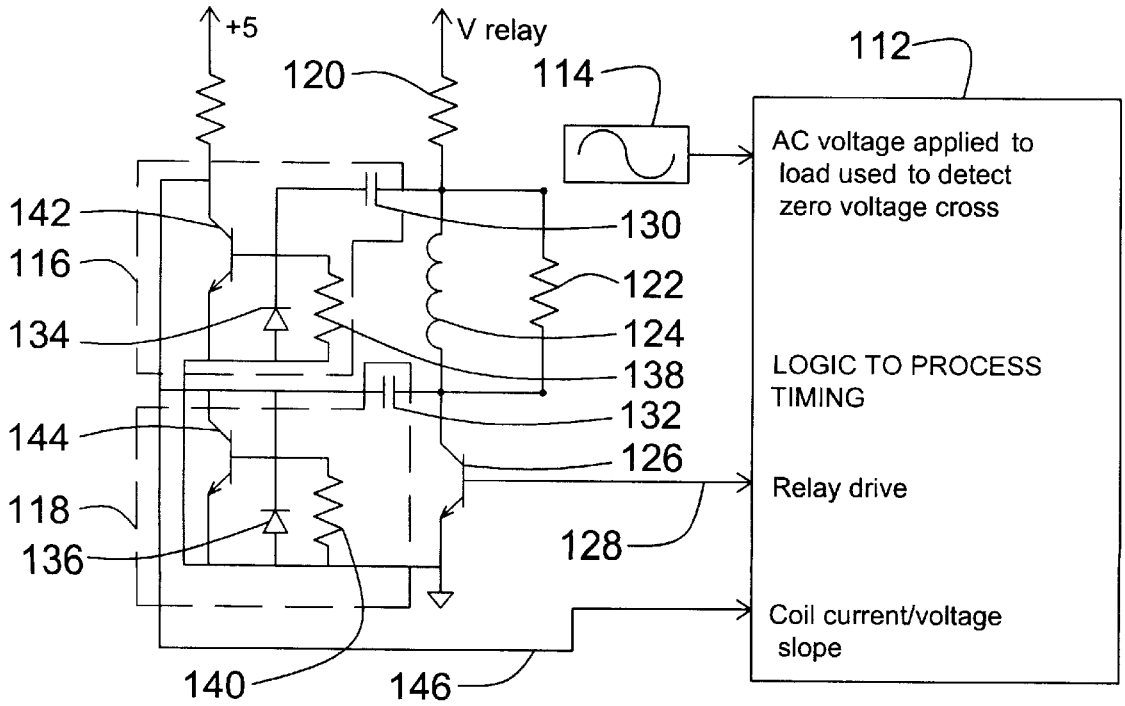
FIG. 4 is a simplified schematic diagram of an embodiment of the instant invention illustrating elements in the embodiment of FIG. 3 in greater detail.
Figure 5:
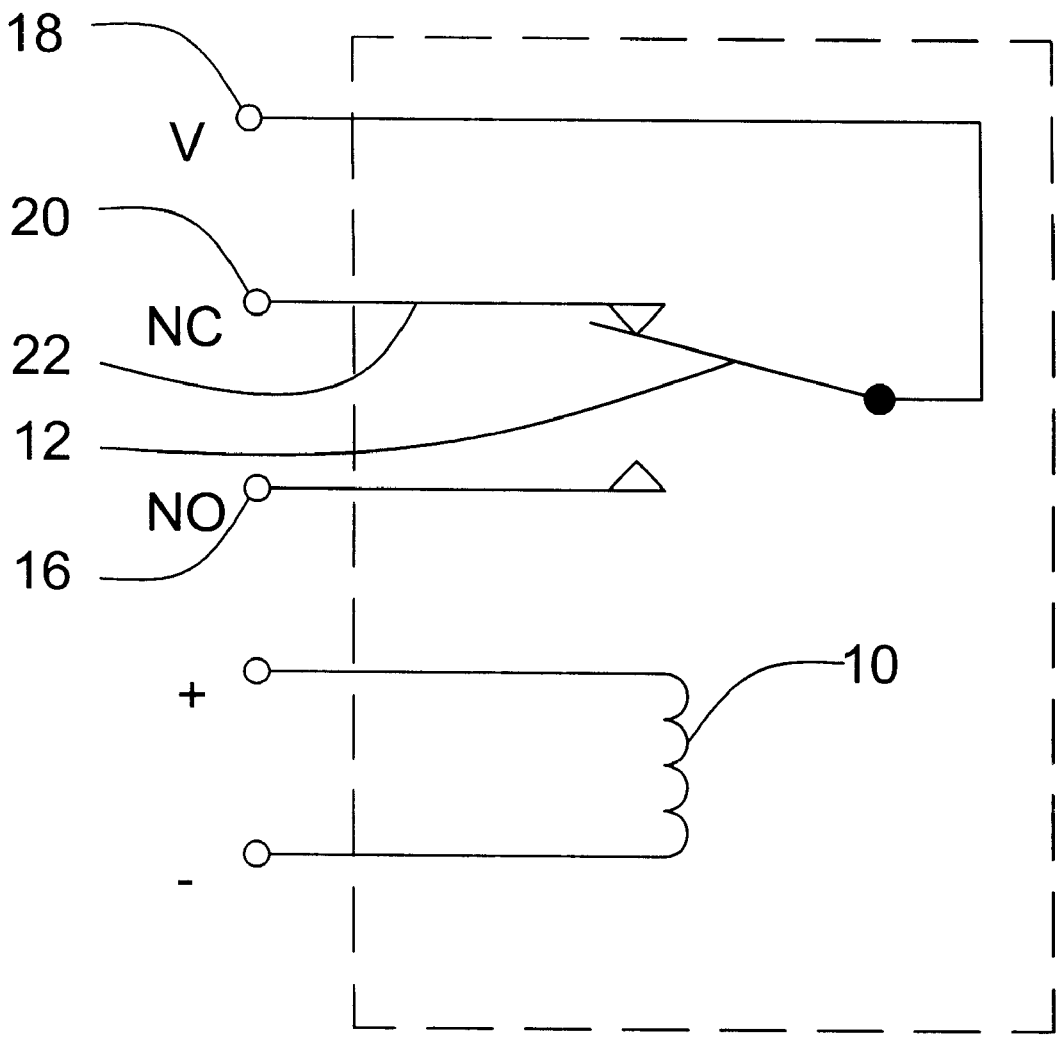
FIG. 5 is a schematic illustration of an electromechanical relay illustrating general concepts of these devices.

While one skilled in the art will recognize the detection of the slope of the current voltage produced by the relay may be implemented in various ways including the use of an amplifier and differentiater, an exemplary implementation of an embodiment of the instant invention is illustrated in FIG. 4. However, this implementation is included by way of example and not by way of limitation, and is not meant to exclude other circuit implementations of the system described above. With this in mind, and turning specifically to FIG. 4, each slope detector 116, 118 comprises a capacitor 130, 132, a diode 134, 136, a resistor 138, 140 and a transistor 142, 144, respectively. In this embodiment, the two detectors 116, 118 are physically wired OR'd together on line 146. It is possible to OR these two circuits together since each slope measurement occurs at different times. This is done to reduce the number of logic ports per relay required for slope detection, resulting in minimization of cost and maximization of reliability. Preferably, the slope signal is greater than 1.2 volts to drive the detector. In operation, a sensed positive slope charges the capacitor (130, 132) through the base-emitter of the transistor (142, 144), and turns the collector of the transistor on. A sensed negative slope turns off the transistor and discharges the capacitor through the diode. The output of the detector is high for a negative slope and low for a positive slope in this implementation. The control logic 112 senses this change to calculate the delay times as described above.

Numerous modifications and alternative embodiments of the invention will be apparent to those skilled in the art in view of the foregoing description. Accordingly, this description is to be construed as illustrative only and is for the purpose of teaching those skilled in the art the best mode for carrying out the invention. Details of the structure and implementation of the various components described above can be varied substantially without departing from the spirit of the invention, and the exclusive use of all modifications that come within the scope of the appended claims is reserved.

I claim:

1. A method of controlling the actuation of an electrical relay having a coil and at least two electrical contacts, one of which being coupled to an electrical source, comprising the steps of:

actuating the relay;

monitoring a first electrical parameter of the coil during actuation of the relay;

calculating an actuation time of the relay based on the monitored first electrical parameter of the coil;

monitoring a second and a third electrical parameter of the electrical source;

calculating an actuation command delay based on the actuation time of the relay and the second parameter of the electrical source; and delaying actuation of the relay for the actuation command delay based on the third electrical parameter.

2. The method of claim 1, wherein the step of monitoring the first electrical parameter of the coil comprises the step of detecting the slope of the first electrical parameter.

3. The method of claim 2, further comprising the step of determining actual actuation of the contacts based a transition to a positive slope of the first electrical parameter following a negative slope of the first electrical parameter.

4. The method of claim wherein the step of actuating the relay comprises the step of actuating the relay to make electrical contact between the two electrical contacts, and wherein the step of monitoring the first electrical parameter of the coil comprises the steps of:

monitoring current flow to the coil;

detecting a slope of the monitored current flow.

5. The method of claim 4, wherein the step of monitoring the first electrical parameter further comprises the step of determining actual closing of the contacts based on a transition to a positive slope of the current flow following a negative slope of the current flow.

6. The method of claim 1, wherein the step of actuating the relay comprises the step of actuating the relay to break electrical contact between the two electrical contacts, and wherein the step of monitoring the first electrical parameter of the coil comprises the steps of:

monitoring voltage across the coil;

detecting a slope of the monitored voltage.

7. The method of claim 6, wherein the step of monitoring the first electrical parameter further comprises the step of determining actual opening of the contacts based on a transition to a positive slope of the voltage following a negative slope of the voltage.

8. The method of claim 1, wherein the step of monitoring a second and a third electrical parameter of the electrical source comprises the steps of monitoring the frequency of the electrical source monitoring a zero cross of the electrical source respectively, and wherein the step of delaying is begun upon detection of a zero cross.

9. The method of claim 1, wherein the step of calculating an actuation command delay comprises the steps of calculating a first actuation command delay for actuation of the relay during a positive half cycle of the electrical source, and calculating a second actuation command delay for actuation of the relay during a negative half cycle of the electrical source.

10. The method of claim 9, wherein the step of delaying actuation comprises the step of alternating between the first actuation command delay and the second actuation command delay.

11. The method of claim 1, wherein the steps of monitoring a first electrical parameter of the coil and calculating an actuation time of the relay are performed upon each actuation of the relay.

12. A method of calculating relay contact actuation time, the relay having at least one coil and at least one set of contacts, comprising the steps of:

monitoring a coil energization command;

monitoring a slope of an electrical parameter of the coil during energization thereof;

determining a point of contact actuation based on a change of the slope of the electrical parameter of the coil;

timing a period from the coil energization command to the point of contact actuation.

13. The method of claim 12, wherein the step of monitoring a slope of an electrical parameter comprises the step monitoring the slope of current flow through the coil.

14. The method of claim 12, wherein the step of monitoring a slope of an electrical parameter comprises the step of monitoring the slope of voltage across the coil.

15. The method of claim 14, wherein the step of monitoring the slope of voltage across the coil is performed during opening of the relay.

16. The method of claim 12 wherein a source of ac electric power is coupled to one of the at least one set of contacts, further comprising the step of monitoring a second electrical parameter of the source of electric power, and wherein the step of timing comprises the steps of:

timing a period from the coil energization command to the point of contact actuation upon relay energization during a positive half cycle of the source of ac electric power; and timing a period from the coil energization command to the point of contact actuation upon relay energization during a negative half cycle of the source of ac electric power.

17. The method of claim 12 wherein the step of timing comprises the steps of:

timing a first period from the coil energization command to the point of contact actuation upon relay energization to close the at least one set of contacts; and timing a second period from the coil energization command to the point of contact actuation upon relay energization to open the at least one set of contacts.

18. The method of claim 17, wherein the step of monitoring a slope of an electrical parameter of the coil during energization thereof comprises the steps of:

monitoring a slope of current flowing through the at least one coil during relay closing; and monitoring a slope of voltage across the at least one coil during relay opening.

19. The method of claim 12, wherein the step of determining a point of contact actuation based on a change of the slope of the electrical parameter of the coil comprises the step of determining the point of contact actuation upon the detection of a positive slope after the occurrence of a negative slope after an initial positive slope upon energization.

20. A relay actuation circuit for use with a relay having at least one coil and at least one set of contacts, at least one of the contacts being coupled to a source of ac electric power, comprising:

a slope detector circuit coupled to the coil and monitoring a slope of a parameter of electric power during energization of the coil;

a relay driver circuit; and a logic processor circuit in sensory communication with said slope detector circuit, and in controllable contact with said relay driver circuit, said logic processor circuit including a timing circuit; and wherein said logic processor circuit determines a relay actuation delay time as a period from initiation of said relay driver circuit to a positive change in slope of said parameter following a negative slope after an initial positive slope.

21. The circuit of claim 20, further comprising a source voltage zero cross sense circuit having an input in sensory communication with the source of ac electric power and an output coupled to said logic processor, and wherein said logic processor monitors said zero cross information and calculates a frequency of the source voltage.

22. The circuit of claim 21, wherein said logic processor circuit calculates a relay actuation command delay time based on said relay actuation delay time and said frequency of the source voltage minimize a voltage difference between each of the contacts of the relay upon actuation thereof, said logic processor circuit initiating operation of said relay driver circuit upon expiration of said relay actuation command delay time, said relay actuation command delay time being started after detection of a zero cross of the source voltage.

23. The circuit of claim 21, wherein said logic processor circuit calculates a first relay actuation delay time for actuation of said relay during a positive half cycle of the source voltage and a second relay actuation delay time for actuation of said relay during a negative half cycle of the source voltage.

24. The circuit of claim 23, wherein said logic processor circuit alternates actuation of the relay between the positive and the negative half cycles of the source voltage.

25. The circuit of claim 21, wherein said logic processor circuit calculates a first relay actuation delay time for opening of the relay contacts, and a second relay actuation delay time for closing of the relay contacts.

26. The circuit of claim 21, wherein said logic processor circuit calculates a first relay actuation delay time for opening of the relay contacts during a positive half cycle, a second relay actuation delay time for opening of the relay contacts during a negative half cycle, a third relay actuation delay time for closing of the relay contacts during a positive half cycle, and a fourth relay actuation delay time for closing of the relay contacts during a negative half cycle.

27. The circuit of claim 20, wherein said slope detector circuit comprises a current sensor circuit coupled in series with the coil for monitoring current through the coil during energization of the coil.

28. The circuit of claim 20, wherein said slope detector circuit comprises a voltage monitor circuit coupled in parallel with the coil for monitoring voltage across the coil during energization of the coil.

29. The circuit of claim 20, wherein said slope detector circuit comprises a current sensor circuit coupled in series with the coil for monitoring current through the coil during energization of the coil to close the contacts, and a voltage monitor circuit coupled in parallel with the coil for monitoring voltage across the coil during energization of the coil to open the contacts.

* * * * *